United States Patent [19]

Estes

[11] Patent Number: 4,833,299

[45] Date of Patent: May 23, 1989

[54] FLEXIBLE HEATING WRAP APPARATUS FOR CHARGED CYLINDERS

[76] Inventor: Eugene J. Estes, 7202 Jasper Ct., Middletown, Md. 21769

[21] Appl. No.: 124,136

[22] Filed: Nov. 23, 1987

[51] Int. Cl.[4] ..... F24H 9/02; H05B 3/02; H05B 1/00

[52] U.S. Cl. ..... 219/311; 219/310; 219/328; 219/335; 219/336; 219/348; 219/349

[58] Field of Search ..... 219/311, 528, 536, 535, 219/548, 549

[56] References Cited

U.S. PATENT DOCUMENTS 3,247,431 4/1966 Kase .
4,149,066 4/1979 Niibe .
4,538,054 8/1985 de la Bretoniere .
4,540,878 9/1985 Sato .
4,633,061 12/1986 Arikawa ..... 219/528

FOREIGN PATENT DOCUMENTS 2810925 10/1978 Fed. Rep. of Germany ..... 219/311
1297366 7/1972 United Kingdom ..... 219/311

*Primary Examiner*—E. A. Goldberg
*Assistant Examiner*—Scott A. Rogers
*Attorney, Agent, or Firm*—Henderson & Sturm

[57] ABSTRACT

A heating wrap apparatus (10) in combination with a pressurized refrigerant cylinder (100); wherein, the heating wrap apparatus (10) comprises a flexible heating unit (11); an insulation unit (12); a housing unit (13) and releasable securing means (14) for engaging the heating wrap apparatus (10) in a circumferential fashion around the periphery of the pressurized refrigerant cylinder (100) to increase the temperature and by extension the pressure of the contents (102) of the cylinder (100).

4 Claims, 1 Drawing Sheet

FLEXIBLE HEATING WRAP APPARATUS FOR CHARGED CYLINDERS

TECHNICAL FIELD

The present invention relates generally to thermostatic controlled heating units, and in particular to a thermostatic controlled, flexible heating unit for the circumferential heating of charged cylinders.

BACKGROUND OF THE INVENTION

As can be seen by reference to U.S. Pat. Nos.: 3,247,431; 4,149,066; 4,538,054; and 4,540,878, the prior art is replete with myriad and diverse patented constructions which provide flexible heating pad elements.

While the prior art constructions are more than adequate for the purpose and function for which they were specifically designed, they fall far short of providing a flexible heating pad construction that is adapted to conform and be releasably secured to a non-linear article.

For instance, the prior art universally lacks any means to secure a heating unit in a configuration that encircles and captures the article to be heated. Furthermore, when gaps exist between the heated pad and the article which is to be heated, heat will be exchanged inefficiently due to convection losses through the gaps.

In addition, the prior art constructions do not effectively utilize insulation to aid in the heat exchange process. This common lack of an external insulation wall allows the generated heat to radiate thru the uninsulated surface, rather than being concentrated, conducted, and transmitted toward the body to be heated; thus resulting in the reduced efficiency of the heating element.

Obviously, there has been a long standing need for a flexible heating construction that will releasably engage and efficiently heat a disparate body. The development of such a construction is the stated purpose and objective of the present invention.

BRIEF SUMMARY OF THE INVENTION

The present invention involves, in general, a flexible heating pad construction designed to transfer heat from the heating pad construction to a specific article such as a refrigerant cylinder. The heating construction of this invention comprises in general a flexible heating unit, an insulation unit, and a housing unit which is used to increase the pressure of refrigerant in a cylinder to facilitate the charging of an air conditioner or refrigeration system during cold weather by raising the temperature of the particular pressurized cylinder involved.

The heating unit that forms the basis of the present invention comprises in general a plurality of flexible heating elements, one or more temperature responsive control elements, and a power supply element; wherein, the heating elements are arranged in a parallel manner, and each temperature responsive control element controls a selected number of the heating elements.

The insulation unit comprises in general a thick, flexible insulation member disposed on one side of the heating unit; wherein, the insulation member is disposed on the exterior of the heating unit so that the majority of the heat generated by the heating unit will be conducted directly to the disparate body.

The housing unit comprises in general: a cover member; a pair of thin flexible insulation elements; and, a restraining means; wherein, the pair of insulation elements each comprises a thin sheet of insulation material which form an envelope which encloses both the heating unit and the insulation unit. The restraining means comprises in general, cooperating hook and loop fastening elements; wherein, the fastening elements are attached at the outboard ends of the housing units in a well recognized fashion.

Briefly stated, the aforementioned arrangement provides a flexible heating pad construction which may be releasably attached and closely conformed around a disparate article, such as a charged refrigerant cylinder; wherein, the cylinder is efficiently heated by this construction.

BRIEF DESCRIPTION OF THE DRAWINGS

These and other objects, advantages, and novel features of the invention will become apparent from the detailed description of the best mode for carrying out the preferred embodiment of this invention which follows, particularly when considered in conjunction with the accompanying drawings, wherein.

BEST MODE FOR CARRYING OUT THE INVENTION

Figure 1:
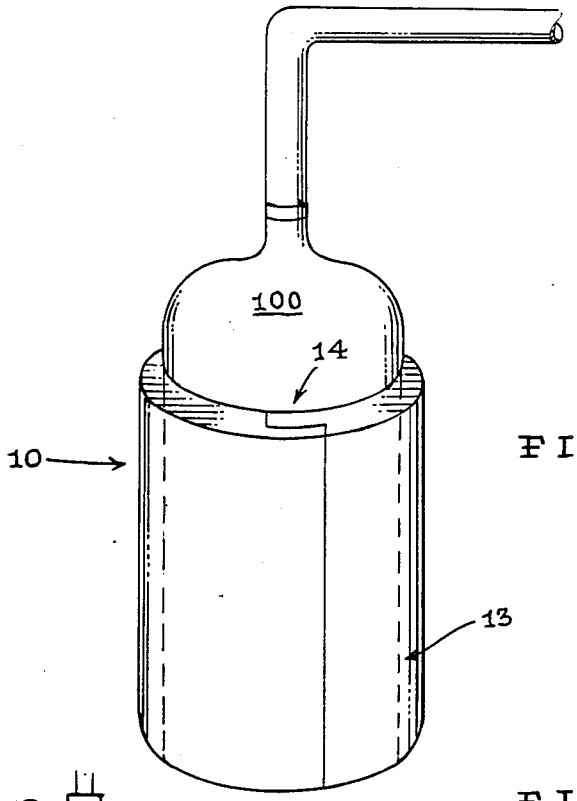
FIG. 1 is a perspective view of the heating wrap apparatus surrounding a refrigerant cylinder.

As can be seen by reference to the drawings and in particular to FIG. 1, the flexible heating wrap apparatus that forms the basis of the present invention was specifically developed for use in combination with a pressurized refrigerant cylinder (100); and, is designated generally by the reference numeral (10). The heating wrap apparatus (10) comprises in general a flexible heating unit (11) an insulation unit (12) a housing unit (13) and a releasable securing means (14).

Figure 2:
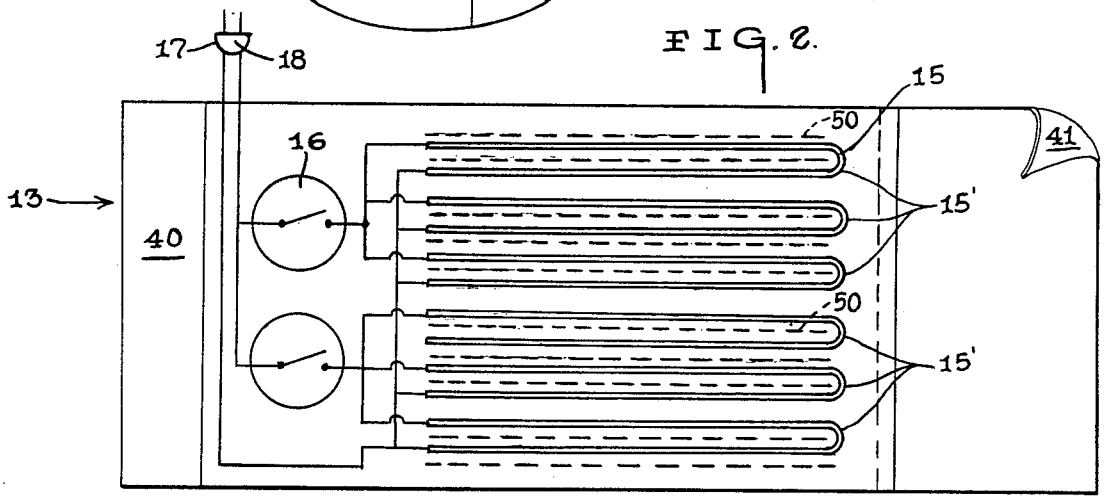
FIG. 2 is a top plan view of the heating elements contained within the apparatus; and, FIG. 3 is a cross-sectional view of the apparatus and cylinder taken thru line 3—3 of FIG. 1.
Figure 3:
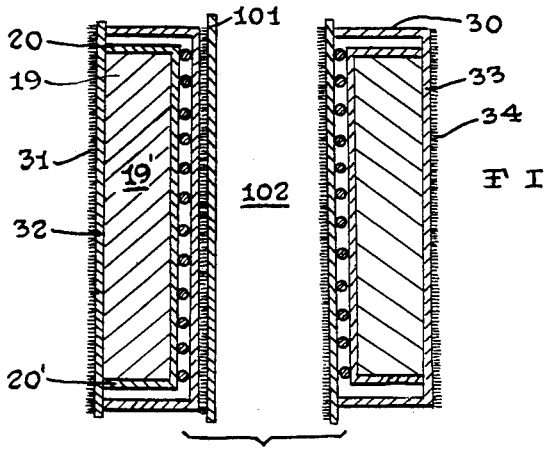

As shown in FIGS. 1 thru 3, the heating wrap apparatus (10) has a generally flat elongated rectangular configuration; wherein, the heating wrap apparatus is dimensioned to circumferentially surround and substantially cover the external walls (101) of a pressurized refrigerant cylinder (100); whereby, the heat generated by the heating wrap apparatus (10) will be transferred through the walls (101) of the refrigerant cylinder to raise the pressure of the pressurized refrigerant contents (102) of the cylinder (100).

As can best be appreciated by reference to FIGS. 2 and 3, the flexible heating unit (11) comprises in general a plurality of flexible heating coil elements (15) arranged into groups (15') of two or more heating coil elements (15); wherein each group of (15') of heating coil elements (15) is provided with its own thermostat member (16); and, all of the groups (15') share a common electrical input and output member (17) in the form of an electrical plug member (18).

The insulation unit (12) comprises in general a relatively thick, generally rectangular flexible mat (19) of insulation material (19') provided with a sheet (20) of insulated fabric (20') that is interposed between the plurality of heating coil elements (15) and the insulated flexible mat (19).

The housing unit (13) comprises a generally elongated fabric envelope (30) that encompasses the flexible heating unit (11) and the insulation unit (12); wherein, the ends of the fabric envelope are provided with the cooperating releasable securing means (14) for wrapping the housing unit (13) and its contents in a circumferential fashion around the periphery of the pressurized refrigerant cylinder as depicted in FIGS. 1 and 3.

In one version of the preferred embodiment the outer layer (31) of the fabric envelope (30) is fabricated from a porous material (32) such as canvas or the like; while, the inner layer (32) of the fabric envelope is fabricated from a non-porous insulated material (33) such as rubberized fabric (34); wherein, the rubberized fabric (34) will enhance the frictional engagement of the housing unit (13) relative to the pressurized cylinder (100).

In another version of the preferred embodiment, both the inner (32) and outer (31) layers of the fabric envelope (30) are fabricated from porous generally heat transmissive material (32); wherein, the heat generated by the flexible heating coil elements (15) will be readily transmitted through the inner (31) layer of the fabric layer (30) to the cylinder (100); and, wherein the presence of the insulation unit (12) will prevent the generated heat from escaping through the outer layer (31) of the fabric envelope.

As can best be appreciated by reference to FIGS. 1 and 2, the releasable securing means (14) comprise hook (40) and loop (41) fastening means which are disposed on opposite sides of each end of the housing unit (13) in order that the heating wrap apparatus (10) may be joined into a generally elongated cylindrical configuration as depicted in FIG. 1.

Referring now in particular to FIG. 2, it can be seen that the generally U-shaped heating coil elements (15) are held in a semi-captive relationship relative to the housing unit (13) and the insulation unit (12) by virtue of a plurality of seams (50) that are sewn or welded at spaced locations both intermediate and adjacent to the openings in the U-shaped coil elements (15); wherein, the seams (50) extend between the inner layer (32) of the fabric envelope (30) and the sheet (20) of insulated fabric (20').

It should be appreciated at this juncture that the mode of operation of the heating wrap apparatus (10) of this invention involves wrapping the apparatus (10) around a refrigerant cylinder (100) and inserting the electrical plug member (70) into an electrical outlet (not shown) to energize the heating elements (15), such that the temperature of the heating elements (15) will rise to and be maintained at a predetermined value that will be dictated by the thermostat members (16); whereby, the heat transfer between the heating wrap apparatus (10) and the walls (101) of the refrigerant cylinder (100) will raise the temperature and consequently the pressure of the contents (102) of the cylinder.

Having thereby described the subject matter of this invention it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A heating wrap apparatus in combination with a pressurized refrigerant cylinder; wherein, the heating wrap apparatus consists of:

a flexible heating unit comprising a plurality of flexible heating coil elements arranged into groups of at least two heating coil elements wherein each of the groups is provided with its own thermostat member and all of the groups share a common electrical input and output member;

an insulation unit disposed adjacent to one side of the flexible heating unit; wherein, the insulation unit comprises: a relatively thick generally rectangular mat of insulation material; and, a sheet of insulated fabric that is disposed intermediate the mat of insulation material and the said plurality of flexible heating coil elements; a housing unit comprising a fabric envelope that surrounds the flexible heating unit and the insulation unit; wherein, the fabric envelope is provided with an inner and outer layer; and, releasable securing means associated with the opposed ends of the housing unit; whereby, the housing unit may be circumferentially engaged to said pressurized refrigerant cylinder.

2. The combination of claim 1 wherein both the inner and outer layer of the fabric envelope comprise a generally porous heat transmitting material.

3. The combination of claim 1 wherein at least the inner layer of the fabric envelope comprises a non-porous insulated material.

4. The combination of claim 1 wherein the releasable securing means comprise:

cooperating hook and loop fasteners that are disposed on the opposite sides of the ends of said fabric envelope such that the fabric envelope may be deployed in a generally cylindrical configuration.

* * * * *